United States Patent [19]

Moses

[11] Patent Number: 5,024,148

[45] Date of Patent: Jun. 18, 1991

[54] COATING REMOVAL DEVICE FOR GRANULAR MATERIALS

[75] Inventor: Darcy Moses, Rush City, Minn.

[73] Assignee: Crown Iron Works Company, Minneapolis, Minn.

[21] Appl. No.: 253,769

[22] Filed: Oct. 5, 1988

[51] Int. Cl.[5] ..... B02B 3/00; B02B 3/04

[52] U.S. Cl. ..... 99/618; 99/574; 99/620; 99/622; 99/628

[58] Field of Search ..... 99/518, 519, 523, 524, 99/574, 575, 617, 618, 620, 600, 609, 622, 628, 623; 426/481, 482; 241/102, 259.1

[56] References Cited

U.S. PATENT DOCUMENTS

| | | | |
|---|---|---|---|
| 3,118 | 6/1843 | Bookman | 99/620 |
| 105,643 | 7/1870 | Carver | 99/618 |
| 207,881 | 9/1878 | Martin | 99/618 |
| 214,653 | 4/1879 | Hann et al. | 99/620 |
| 778,193 | 12/1904 | Hartmann | 99/523 |
| 1,320,968 | 11/1919 | Baudendistel | 99/628 |
| 1,460,004 | 6/1923 | Warren | 99/628 |
| 1,683,004 | 9/1928 | Voigt | 99/628 |
| 2,151,805 | 3/1939 | Schei | 99/628 |
| 2,435,592 | 2/1948 | Loewy | 99/620 |
| 2,585,525 | 5/1882 | Brown | 241/102 |

FOREIGN PATENT DOCUMENTS

| | | | |
|---|---|---|---|
| 24050 | 12/1892 | United Kingdom | 99/618 |

*Primary Examiner*—Timothy F. Simone
*Attorney, Agent, or Firm*—Lawrence M. Nawrocki

[57] ABSTRACT

A device for removing coatings from granular materials such as hull-encased meats of grains. The device includes a housing within which is journaled a rotatably disposed drum. A wall is also mounted within the housing, the wall angling downwardly and being spaced at a distance from an outer surface of the drum to define a processing space therebetween. Typically, the processing space narrows downwardly within the housing. The drum is disposed for rotation so that any material fed into the housing through a hopper mounted on the top thereof will be drawn along the drum surface into the processing space. The processing space narrows sufficiently so that an abrasion is effected upon the material as it is deposited within the processing space because of the relative movement of the outer surface of the drum and the downwardly extending wall.

7 Claims, 2 Drawing Sheets

COATING REMOVAL DEVICE FOR GRANULAR MATERIALS

TECHNICAL FIELD

The present invention deals broadly with the treatment of granular materials such as oilseeds or other bulk vegetable materials. In the case of such organic products, they are processed to remove the skin-like portion, known as the hull, from the center portion, known as the meat. The present invention deals with a technology whereby such encasing portions are removed from the meat. A preferred embodiment of the invention deals with removing such encasements by a mechanical device which not only abrades the encasements, but which also facilitates abrasion of the granular materials against other grains in the bulk mass.

BACKGROUND OF THE INVENTION

Various organic products, in order to facilitate recovery of desired portions thereof, are processed such that outer encasements, known as hulls, are removed from inner portions of the material, known as the meats. Typically, such processing involves the separation and removal of the hull from the meats so that the meats can be further utilized. One example of an organic granular material which is so processed is soybeans. In the case of this oilseed, it is desirable to remove the hulls from the meats prior to recovering oil from the meats.

Strong interest has been generated in effecting efficient removal because of the necessity of reducing costs in the soybean processing industry. These costs include various components, among them being labor and energy. These two particular costs tend to be increased above what might otherwise be incurred because of inefficient removal of hulls from soybean meats.

Various considerations bear upon how hulls are removed from soybean meats. Some of these include the desire to minimize the time involved in removing the hulls, and the need to minimize damage to the meats in the removal process. Certainly, apparatus which would enable minimization of time and, concurrently, maximization of protection of the meats be a significant advance. That is, if hull removal could be expedited without incurring greater risks of damaging the meats during hull removal, the process could be performed much more efficiently. The costs discussed above would, thereby, be reduced.

It is to these problems and desirable features dictated by the prior art that the present invention is directed. It is a device which improves over all known devices which seek to accomplish the goals of the present invention.

SUMMARY OF THE INVENTION

The present invention is an improved apparatus for removing a skin-like coating from the nucleus of each grain of granular material fed to the device in bulk form. The apparatus includes a downwardly extending wall. A rotatably disposed drum is mounted for rotation about an axis. The drum is disposed relative to the downwardly extending wall so that, as the drum rotates about its axis, an outwardly facing surface of the drum passes closely proximate the downwardly extending wall. A narrow processing space is, thereby, defined between the drum and the downwardly extending wall.

Means are provided for introducing material to be processed into the narrow processing space.

In one embodiment of the invention, the downwardly extending wall is arcuate in configuration. The arcuity with which the wall is provided, can be similar to the curvature of the annular wall defining the drum. The downwardly extending arcuate wall can, thereby, be disposed, relative to the drum, so that it is approximately parallel to the outwardly facing surface of the drum.

In a preferred embodiment, however, the narrow processing space between the drum and the arcuate wall narrows as the granular material from which the skin-like coatings are to be removed pass downwardly along the outwardly facing surface of the drum. More efficient removal of hulls from, for example, soybeans can thus be achieved.

It has been found that rotation of the drum in a direction downwardly across the face of the downwardly extending arcuate wall more efficiently removes hulls. Such rotation maximizes the abrasion of the granular materials with the outwardly facing surface of the drum and the arcuate wall, and with other grains of the mass material in order to facilitate more efficient removal.

The invention contemplates the employment of a hopper in which the mass material is held prior to its introduction to the narrow processing space between the drum and the arcuate wall. Such a hopper envisions the employment of a downwardly-tapered enclosing wall at the bottom of which an egress aperture of the hopper is defined. The materials to be processed are placed in such a hopper and allowed to be fed onto the drum and into the processing space.

In the preferred embodiment, both the outwardly facing surface of the drum and the surface of the downwardly extending arcuate wall opposite the face of the drum are made of a material which retards movement of the processed material across those faces. Because of the relative movement of the drum across the arcuate wall, a better abrading effect will be achieved, therefore. The preferred embodiment of the invention envisions employment of a rubber lamina on each of the outwardly facing surface of the drum and the surface of the arcuate wall facing the drum.

The invention can employ means for varying the distance at which the drum and downwardly extending arcuate wall are spaced from one another. A plurality of fittings mounting the arcuate wall relative to the drum are contemplated as functioning as such means. The fittings can be discrete and operable independently of one another. Consequently, not only can they permit adjustment of the distance between the wall and drum, but they also can enable variance of the relationship of the arcuate wall relative to the drum to narrow the processing space more at a lower end thereof.

Since a goal of the device in accordance with the invention is to minimize time necessary to process a particular volume of granular material, it is desirable that down-time be minimized. The apparatus of the present invention can, therefore, include means to automatically permit withdrawal of the downwardly extending arcuate wall from an intended position relative to the drum when the processing space between the wall and the drum becomes clogged. Automatic retraction of the wall enables material clogging the space to pass therethrough without creating a jam of the machine.

The present invention is thus an improved device for processing granular materials to remove a skin-like encasement from a nucleus of a grain of bulk granular materials. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figure 1:
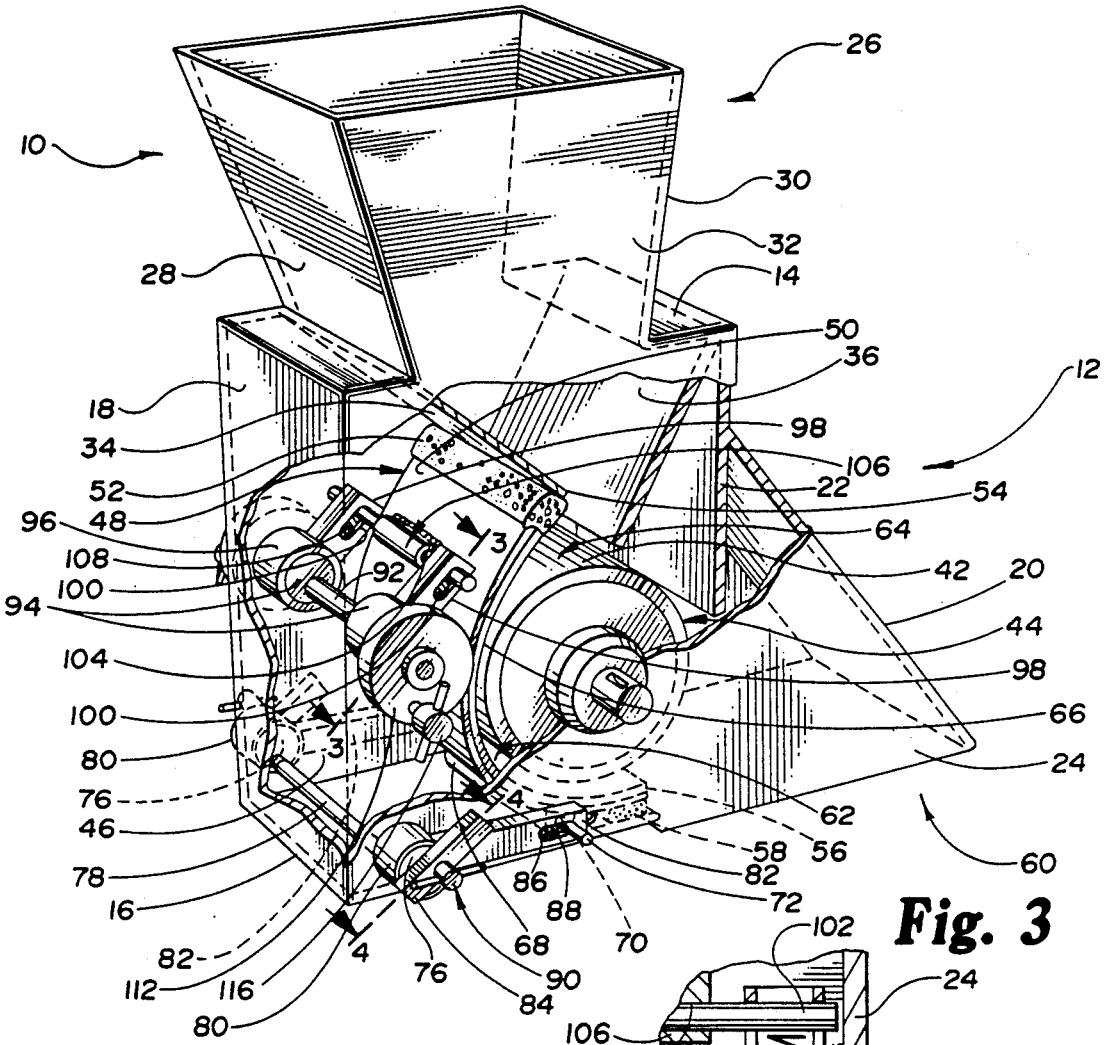
FIG. 1 is a perspective view of the device in accordance with the present invention with some parts thereof being cut away.
Figure 2:
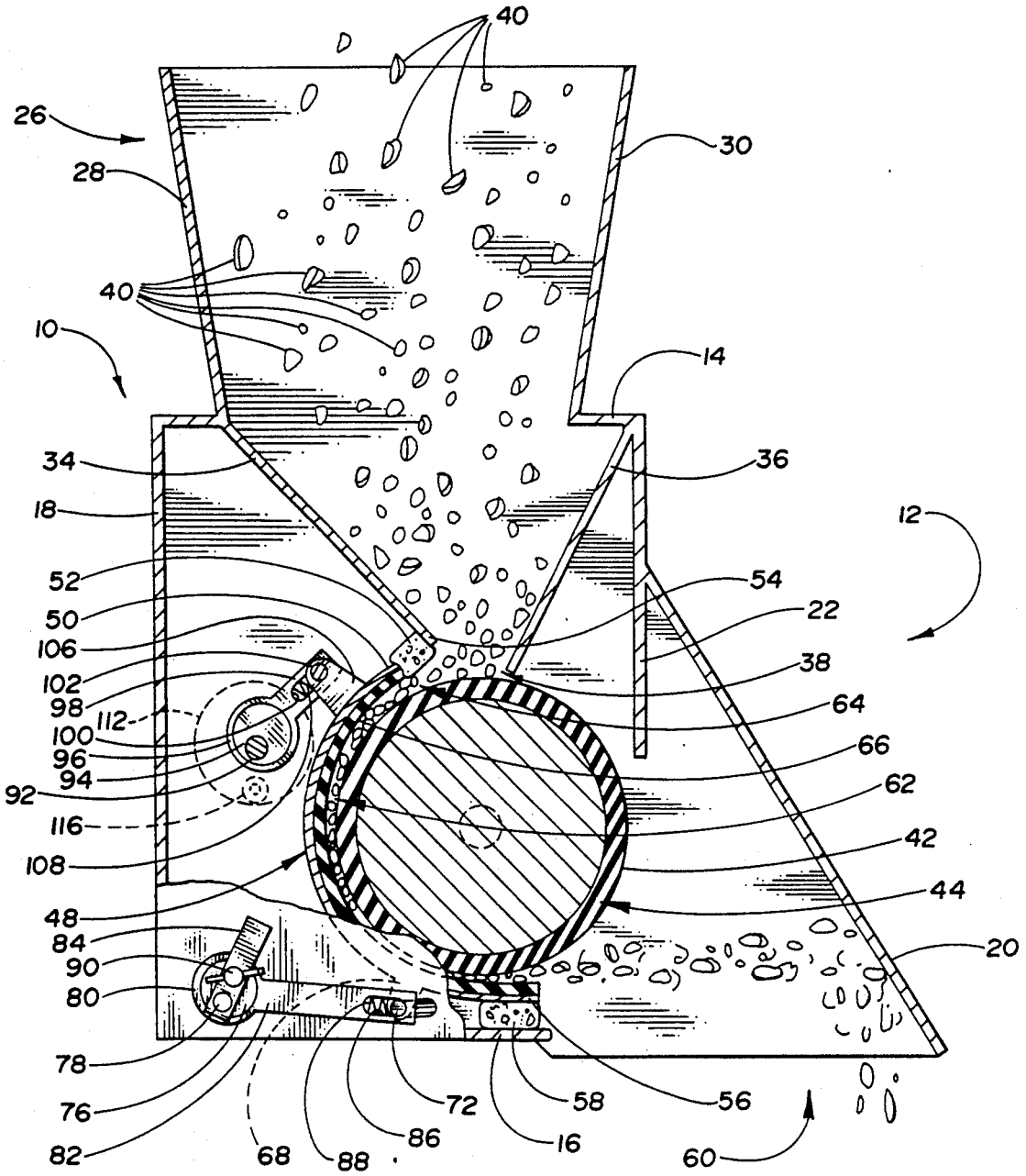
FIG. 2 is a fragmentary side elevational view of the device of FIG. 1, with some parts being cut away.

Referring now to the drawings wherein like reference numerals denote like elements throughout the several views, FIGS. 1 and 2 illustrate apparatus 10 in accordance with the present invention. The removal device 10 includes a housing 12 having top and bottom walls 14, 16, a generally vertically extending front wall 18, an obliquely angled rear wall 20, a generally vertically extending baffle 22 which the oblique rear wall 20 intersects, and a pair of side walls 24.

A hopper 26 is mounted atop the housing 12, the hopper 26 including front and rear walls 28, 30 and a pair of side walls 32 external to the housing 12, and front and rear converging walls 34, 36, internal to the housing 12, which define an egress aperture 38 from the hopper 26. It will be noted that the rear converging wall 36 of the hopper 26 within the housing 12, while such construction is not essential to the invention, is illustrated as being rearwardly displaced along the top wall 14 of the housing 12 from a location at which the rear wall 30 of the hopper 26, external to the housing 12, intersects the housing's top wall 14.

The walls 34, 36 of the hopper 26, internal to the housing 12, extend laterally fully between the housing side walls 24. Together, the hopper converging walls 34, 36 within the housing 12 define an egress aperture 38 of the hopper 26 from which bulk granular materials 40 fed into the hopper 26 exit the hopper 26. The egress aperture 38 is disposed such that materials exiting the hopper 26 will be deposited on the top of an outwardly facing surface 42 of a drum 44 journaled between the housing side walls 24.

Bulk material exiting the hopper 26 will be conveyed, as viewed in FIG. 2, to the left. This is so for a number of reasons. First, the rear converging wall 36 of the hopper 26 disposed within the housing 12 serves a baffle function to preclude movement to the right. The baffle 22, additionally, backs up the rearward converging wall 36 in performing this baffle function.

Second, however, the direction of rotation of the drum 44, again as viewed in FIG. 2, is counter clockwise. Consequently, any material deposited on the top of the drum 44 will be drawn along the drum surface 42 to the left.

The axial dimension of the outwardly facing surface 42 of the drum 44 is substantially the same as the distance between the side walls 24 of the housing 12. There would, typically, of course, be some minor gap in order to permit rotation of the drum 44 relative to the housing 12. Because of the drum 44 extending substantially fully across the dimension between the housing sidewalls 24, however, material exiting from the hopper 26 through the egress aperture 38 thereof will not be able to pass, in any significant measure, between the ends of the drum's outwardly facing surface 42 and the housing sidewalls 24. Alternatively, cheek plates, or lands (not shown), could be mounted to inwardly facing surfaces 46 of the housing side walls 24 to deflect granular materials 40 from the edges of at least the upper side of the drum 44. A wall 48, extending downwardly from the forward converging wall 34 of the hopper 26 disposed within the housing 12 is also mounted within the housing 12. This wall 48, as is true of the drum 44, extends substantially fully from one lateral wall of the housing 12 to the other.

An upper end 50 of the wall 48 engages, through a seal 52, the forward converging wall 34 of the hopper 26 disposed within the housing 12 proximate a lower end 54 of that converging wall 34. A lower end 56 of the downwardly extending wall 48 engages, through another seal 58, the bottom wall 16 of the housing 12 proximate an end thereof which terminates, at a distance from the rear oblique wall 20 of the housing 12, to define a housing discharge 60.

The seals 52, 58 can be formed from any appropriate material. The seals 52, 58, together with the wall 48, preclude granular material 40 introduced into the housing 12 from passing to the left, as viewed in FIG. 2.

In order to accomplish this end, the material from which the seals 52, 58 are formed is elastomeric in nature so that, as the wall 48 is adjusted toward and away from the drum 44 in a manner that will be discussed hereinafter, the seals 52, 58 will not permit any discontinuity to be introduced between the ends 50, 56 of the wall 48 and the structures against which those ends 50, 56 are sealed.

The wall 48 shown in the figures is arcuate, and it is provided with a measure of arcuity approximating the measure of curvature of the outwardly facing surface 42 of the drum 44. A processing space 62 is, thereby, defined between the wall 48 and the drum 44.

The upper end 50 of the wall 48 shown in the drawing figures, however, is less arcuate than is the lower end 56 of the wall 48. A mouth 64 through which granular material 40 passing from the egress aperture 38 of the hopper 26 into the processing space 62, therefore, is wider than is a dimension of the processing space 62 located farther down-stream. This structuring in relationship of the various components thereby facilitates entry of the bulk material 40 passing from the hopper 26 into the processing space 62.

As previously discussed, the wall 48 is adjustable, at least along a portion thereof, toward and away from the outwardly facing surface 42 of the drum 44. Adjustment can be accomplished to create a desired spacing. The particular spacing sought to be achieved will depend upon a number of factors including the size of the grains of the materials 40 sought to be processed.

It has been found that when processing, for example, soybeans, effective removal of the hulls from the meats is achieved by maximizing abrading forces brought to bear upon individual grains. Abrading forces can be maximized by providing the outwardly facing surface 42 of the drum 44 and the surface 66 of the wall 48 opposite the drum's surface 42 with a coating of material having a relatively high coefficient of friction. It has been found that a layer of rubber adequately serves this function.

Downward movement of grains of the material 40 being processed would tend to be retarded by the rubber surface 66 of the arcuate wall 48. Similarly, any tendency toward relative movement of the grains in a relative clockwise direction tended to be induced by the effects of arcuate wall 48 will be retarded by the rubber coating of the drum 44.

The apparent opposite relative movement of the drum 44 with respect to the arcuate wall 48 will increase the abrasive forces brought to bear upon the granular materials 40 being processed. It has been found that, by spacing the arcuate wall 48 at a distance from the drum 44 somewhat greater than the typical dimension of a grain will not only facilitate abrasion of the grains with the surfaces 42, 66 of the arcuate wall 48 and drum 44, but will also increase abrasion of grains of the material by adjacent grains. Consequently, the over-all hull removal effect tends to be maximized.

The figures illustrate envisioned structure for effecting movement of the wall 48 toward and away from the drum 44. The wall 48, at its lower end 56, is provided with a shackle 68 having a channel 70, passing along an axis generally perpendicular to a plane defined by one or both of the housing side walls 24, passing therethrough. A rod 72 passes through this channel 70, ends of the rod 72 extending through slots in the housing side walls 24 which are aligned along axes oriented in the intended directions of adjustment of the lower end 56 of the wall 48 toward and away from the drum 44. Movement of the lower end 56 of the wall 48 is accomplished by urging this lower shackle 68 mounted to the wall 48, in the desired direction.

A pair of eccentrics 76 are secured to opposite ends of an eccentric axle 78 which passes through the housing 12 forward of the slots in the housing side walls 24. The eccentrics 76 rotate freely within journals 80 carried by forward ends of corresponding shackle links 82. Rearward ends of the links 82 constrain the ends of the rod 72, passing through the shackle 68, which are external to the housing 12.

An adjustment lever 84 is provided for rotating the eccentrics 76. A lever 84 can be provided on either side of the housing 12, and each lever 84 so provided is rigidly attached to a distal end of the eccentric axle 78 projecting beyond the corresponding eccentric 76. As an adjustment lever 84 is pivoted, the eccentric 76 to which it is mated will rotate. As the eccentric rotates, it will, in turn, drive its corresponding shackle link 82 in a direction so that the lower end 56 of the arcuate wall 48 moves either toward or away from the drum 44, depending upon the direction the adjustment lever 84 is pivoted.

As seen in FIGS. 1 and 2, the rearward ends of the lower shackle links 82 are each provided with an elongated slot 86, oriented generally along an axis of intended movement of the lower end 56 of the arcuate wall 48, in which a corresponding distal end of the rod 72 received through the lower shackle channel 70 is held. The rod 72 is held at an end of the slot 86 away from the corresponding eccentric 76 by a compression spring 88 which engages, at one end thereof, a shoulder (not shown) within the shackle link 82, and, at the other end thereof, the rod 72. The purpose of this slot 86 and the corresponding compression spring 88 will be discussed hereinafter.

A lock screw 90 can be provided to secure an adjustment lever 84 and, therefore, in turn, the corresponding eccentric 76 at a desired rotative position to maintain the arcuate wall 48 at an intended location proximate the drum 44. As the lock screw 90 is tightened, the adjustment lever 84 will be tightened down against the journal 80 at the forward end of the shackle link 82 in order to preclude unintended pivoting of the adjustment lever 84.

An upper shackle assembly similar to the lower shackle assembly, is provided. An upper eccentric axle 92 extends across the housing 12 and protrudes from either side of the housing 12 from beyond the housing side walls 24. Each end of the axle 92, but within the housing side walls 24, mounts an eccentric 94. As in the case of the lower shackle assembly, each upper eccentric 94 rides within a journal 96 at one end of a shackle link 98. Opposite ends of the upper shackle links 98 are provided with slots 100 receiving an upper shackle rod 102 passing through a channel 104 in an upper shackle 106 secured to the arcuate wall 48. Again, as in the case of the lower shackle assembly, distal ends of the upper rod 102 pass through the slots 100 formed in the shackle links 98. These slots 100 are elongated along an axis in a direction of which the upper portion of the arcuate wall 48 is intended to move in being adjusted toward and away from the drum 44.

Figure 3:
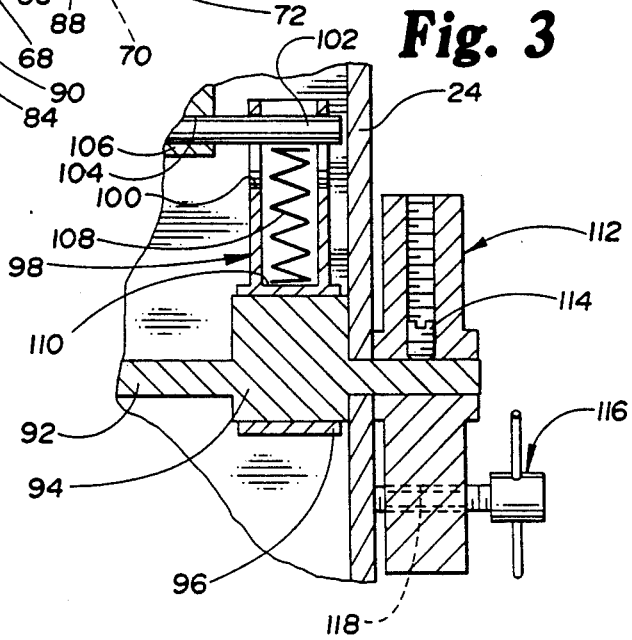
FIG. 3 is a sectional detailed view, slightly enlarged, taken generally along the line 3—3 of FIG. 1.
Figure 4:
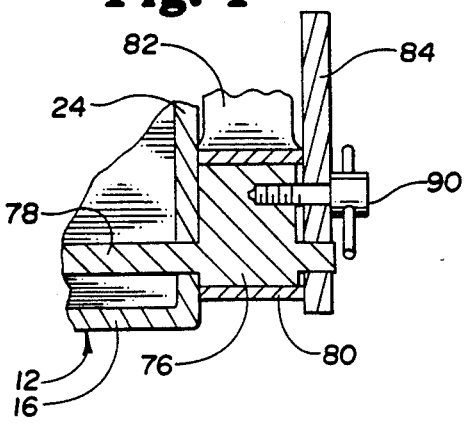
FIG. 4 is a sectional detailed view, slightly enlarged, taken generally along the line 4—4.

As seen in FIG. 3, the upper shackle links 98 are also provided with compression springs 108 which urge the upper rod 102 to a position, along the corresponding slots 100, away from corresponding eccentrics 94. One end of each compression spring 108 engages a shoulder 110 within the shackle link 98. The other end of the spring 108 engages the rod 102 to urge the rod 102 to the desired end of the slot 100.

As the upper eccentrics 94 are maintained between the side walls 24 of the housing 12, distal ends of the upper eccentric axle 92 are also constrained within the housing 12. An adjustment wheel 112 is secured to each of these ends by appropriate means such as a set screw 114. Consequently, as one or both of the adjustment wheels 112 is rotated, the eccentrics 94 will also be rotated. Rotation of the upper eccentrics 94 will have the effect of moving the shackle links 98 so as to urge the rod 102 and the upper shackle 106 in a desired direction.

Again, as in the case of the lower shackle assembly, a lock screw 116 can be provided. This lock screw 116 is threaded through an aperture 118 in the adjustment wheel 112 and, when tightened down, can be brought to bear upon the outside corresponding side wall 24 of the device housing 12. When this is accomplished, undesired movement of the eccentrics 94 and shackle links 98 will be precluded.

It will be understood that the compression springs 88, 108 in each upper and lower shackle link 82, 98 have an elasticity sufficiently great to maintain the respective upper and lower shackle rods 72, 102 at the ends of the slots 86, 100 in the shackle links 82, 98 away from their corresponding eccentrics 76, 94. If, however, a clod of compressed granular material or a foreign body passes into the mouth 64 of the processing space 62 between the arcuate wall 48 and the drum 44, sufficient pressure can be brought to bear upon the arcuate wall 48 so as to overcome the compression of the springs 88, 108 and drive the arcuate wall 48 away from the drum 44. The upper and lower shackle rods 72, 102 will ride in their respective slots 86, 100 in their corresponding shackle links 82, 98 in a direction away from the ends of the slots 86, 100 which were originally occupied.

As will be able to be seen in view of this disclosure, the ends 50, 56 of the arcuate wall 48 corresponding to the upper and lower shackle assemblies will be allowed to be driven away from the drum 44 in order to open the distance between the arcuate wall 48 and the drum 44. Consequently, passage of the clod of grain or foreign body will be permitted.

Figure 5:
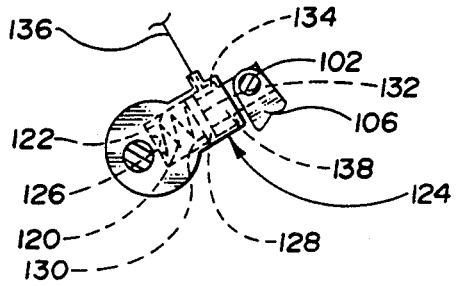
FIG. 5 is a detailed view of an alternative sub-assembly for variation of the position of the arcuate wall.

FIG. 5 illustrates an alternative embodiment of a shackle assembly particularly appropriate for use in adjusting the upper portion of the arcuate wall 48. A compression spring 120 is received within a chamber 122 within the shackle link 124. The spring 120 engages, at one end thereof, an end 126 of the chamber 122 and, at the other end thereof, a piston 128 disposed for axial movement along the chamber 122. A side 130 of the piston 128 opposite that side 132 engaged by the spring 120 faces into a portion 134 of the chamber 122 which communicates with a fluid source (not shown) through a duct 136. By introducing fluid into the chamber 122 on this side of the piston 128, the location of the piston 128 and, in turn, the location of the arcuate wall 48 with respect to the drum 44 can be varied. This is so, since the piston 128 is mounted at an end of a shaft 138, the other end of which is mated to the upper shackle 106.

It will be understood that, while the piston 128 is adjusted away from its corresponding shackle 106, and the wall 48 is withdrawn to a position farther from the drum 44, the piston 128 would never be adjusted such that the spring 120 would be completely compressed. If this were done, the emergency override feature would not be available. As long as there is some measure of compression of the spring 120 yet available, however, the override feature is provided.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. Apparatus for removing skin-like coatings from nuclei of a material to be processed, which nuclei the coatings encase, comprising:

(a) a housing including a pair of opposite, generally-parallel side panels;

(b) a drum disposed between said housing side panels for rotation about an axis, said drum having an outwardly facing surface;

(c) an arcuate wall disposed between said housing side panels and positioned such that an inner concave surface of said wall is disposed closely proximate said outwardly facing surface of said drum to define a narrow processing space between said inner concave surface of said wall and said outwardly facing surface of said drum, said processing space narrowing downwardly along said outwardly facing surface of said drum;

(d) means mounting said wall to enable variation of the distance at which said wall is disposed proximate said drum, said mounting means including:

(i) a shackle secured to an outer convex surface of said wall proximate a lower end thereof;

(ii) an eccentric cam mounted to one of said housing side panels and disposed for rotation about an axis generally perpendicular to said housing side panel to which said cam is mounted; and (iii) an elongated linkage member pivotally attached to said shackle and extending to, and being in operative engagement with, said eccentric cam;

(iv) wherein, as said eccentric cam is rotated, said linkage member reciprocates to effect movement of said wall; and (e) means for introducing material to be processed into said processing space.

2. Apparatus in accordance with claim 1 further comprising means for driving said drum in rotation about said axis in a direction downwardly across said arcuate wall.

3. Apparatus in accordance with claim 1 wherein said means for introducing material to be processed into said processing space comprises a hopper having an enclosing wall tapered downwardly to define an egress aperture above said drum.

4. Apparatus in accordance with claim 1 wherein said concave surface of said arcuate wall facing said drum, and said outwardly facing surface of said drum are made of a material so as to retard movement thereacross of material to be processed.

5. Apparatus in accordance with claim 4 wherein said concave surface of said arcuate wall and said outwardly facing surface of said drum are made of rubber.

6. Apparatus in accordance with claim 1 further comprising means for facilitating automatic withdrawal of said arcuate wall from an intended location relative to said outwardly facing surface of said drum in response to said processing space becoming clogged.

7. Apparatus in accordance with claim 6 wherein said means for facilitating withdrawal of said wall includes a bar extending laterally from said shackle into a slot formed in said linkage member, and a compression spring housed within said linkage member to urge said rod toward said drum.

* * * * *